United States Patent [19]

Nishino et al.

[11] 4,026,253

[45] May 31, 1977

[54] FUEL-AIR MIXTURE SUPPLY SYSTEM

[75] Inventors: Katsumi Nishino; Toshiaki Konomi, both of Susono, Japan

[73] Assignee: Toyota Jidosha Kogyo Kabushiki Kaisha, Toyota, Japan

[22] Filed: Apr. 5, 1974

[21] Appl. No.: 458,135

[30] Foreign Application Priority Data

May 11, 1973 Japan ..... 48-51628

[52] U.S. Cl. ..... 123/127; 48/180 S; 123/52 M; 123/141; 261/23 A; 261/89

[51] Int. Cl.[2] ..... F02M 19/00

[58] Field of Search ..... 261/23 A, 89, 24, 28; 48/180 S, 180 R; 123/52 M, 52 MC, 141, 127

[56] References Cited

UNITED STATES PATENTS

| | | | |
|---|---|---|---|
| 1,076,634 | 10/1913 | Heath | 48/180 S X |
| 1,212,013 | 1/1917 | Burke | 48/180 S |
| 1,741,280 | 12/1929 | Brewer | 48/180 S X |
| 1,768,136 | 6/1930 | Moorhouse | 123/52 MC X |
| 2,027,480 | 1/1936 | Higley | 123/141 |
| 2,935,055 | 5/1960 | Neir | 123/52 M X |
| 3,308,797 | 3/1967 | Buyatti | 123/52 M X |
| 3,544,290 | 12/1970 | Larson, Sr. et al. | 48/180 S X |
| 3,615,296 | 10/1971 | Guarnaschelli | 48/180 S X |

*Primary Examiner*—Frank W. Lutter
*Assistant Examiner*—William A. Cuchlinski, Jr.
*Attorney, Agent, or Firm*—Stevens, Davis, Miller & Mosher

[57] ABSTRACT

In a fuel-air mixture supply system, a rotor is provided at the junction of an intake manifold into which the mixture is supplied from the carburetor, and the branch pipes from the intake manifold are arranged equidistantly. The carburetor has a primary side mixture passage and a secondary side mixture passage, and the rotor is disposed beneath the primary side passage and arranged to be checked in rotation corresponding to the opening behavior of a throttle valve in the secondary side mixture passage.

9 Claims, 4 Drawing Figures

FUEL-AIR MIXTURE SUPPLY SYSTEM

BACKGROUND OF THE INVENTION

1. Field of the Invention

This invention relates to a fuel-air mixture supply system whereby fuel in the fuel-air mixture produced in the carburetor is well vaporized and also the mixture is evenly distributed to the respective cylinders of the engine.

2. Description of the Prior Art

Generally, the fuel-air mixture produced in an internal combustion engine is supplied to the respective cylinders in the engine body through an intake manifold. It is, however, often experienced that fuel in the mixture would adhere to the riser of the intake manifold to hinder uniform supply of the mixture to the respective cylinders. Attempts have therefore been made to modify the internal configuration of the intake manifold or to heat the mixture to expedite vaporization of fuel. Nevertheless, these attempts were not sufficient to realize satisfactorily uniform feed of the mixture to the respective cylinders. Therefore, there still remained the problem that the engine performance is lowered when a lean mixture is supplied to the respective cylinders through the intake manifold, while harmful substances such as carbon monoxide (CO) and hydrocarbons (HC) in the engine exhaust gas are increased when a rich mixture is supplied to the intake manifold.

SUMMARY OF THE INVENTION

The present invention is intended to solve these problems in the prior art, and to this end, there is provided according to the present invention an improved fuel-air mixture supply system characterized by a specific arrangement in which the primary side mixture passage in a two-barrel carburetor is joined to the junction of the intake manifold and a rotary member is provided in said junction of the intake manifold, with the branch pipes from said intake manifold being arranged equidistantly from each other around said rotary member, and wherein rotation of said rotary member is interrupted when a throttle valve in the secondary side mixture passage is opened.

DESCRIPTION OF THE PREFERRED EMBODIMENT

Figure 1:
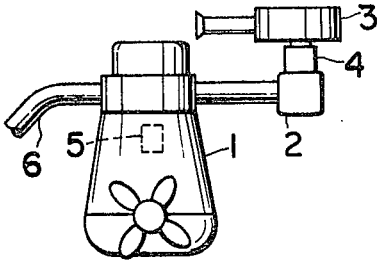
FIG. 1 is a systematic diagram of an engine incorporated with a mixture supply system according to the present invention.
Figure 2:
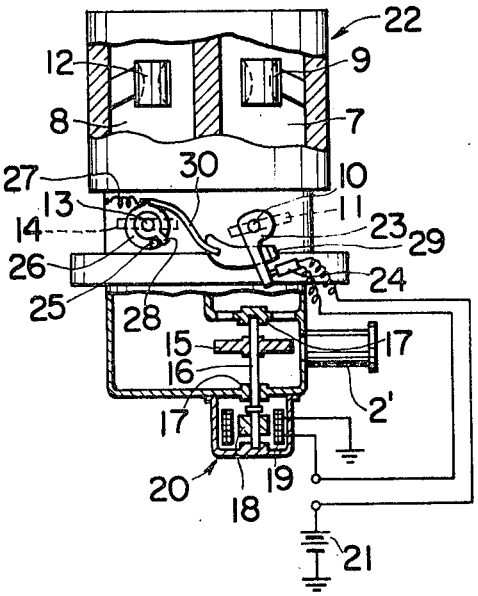
FIG. 2 is a side elevation, with parts broken away, of the carburetor section of the system.
Figure 3:
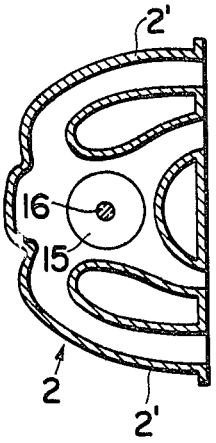
FIG. 3 is a sectional view of the intake manifold in the system.

The present invention is now described in detail by way of an embodiment thereof with reference to FIGS. 1 to 3.

It will be seen that fuel-air mixture is supplied into the engine 1 from an air cleaner 3 and a double throw carburetor 4 through an intake manifold 2, and such mixture is burned in the respective cylinders 5 in the engine 1, with exhaust gas thereof being released into the atmosphere through the exhaust manifold 6. The two-barrel carburetor 4 has formed therein a primary side mixture passage 7 and a secondary side mixture passage 8. In the primary side mixture passage 7 are provided a venturi 9 and a throttle valve 11 turnable about a shaft 10. A similar venturi 12 and a similar throttle valve 14 turnable about a shaft 13 are also provided in the secondary side mixture passage 8. These means are arranged such that the throttle valve 11 in the primary side mixture passage 7 alone is opened during the normal running of the engine, but as engine load is increased, the throttle valve 14 in the secondary side mixture passage 8 is also opened. The double throw carburetor 4 is communicated with the intake manifold 2 in such a way that the center of the junction of said intake manifold 2 is aligned with the center axis of the primary side mixture passage 7, and branch pipes 2′ branch off from said junction equidistantly from each other and radially of a disc 15 described below. Said disc 15 is provided such that its revolving shaft 16 becomes the center of the junction of the intake manifold 2. Said revolving shaft 16 is supported by a bearing 17. According to this arrangement, the mixture supplied from the mixture passage 7 is guided by the disc 15 and distributed into the respective branch pipes 2′ which bend at substantially right angles to the passage 7. The central shaft 16 of the disc 15 extends outside of the intake manifold 2 and is connected to an electric motor 20 having an armature 18 and a field coil 19, whereby said shaft 16 is rotated. The coil 19 of said electric motor 20 is electrically connected to a battery 21 through a switch 24 which is described later. The shaft 10 of the throttle valve 11 provided in the primary side mixture passage 7 protrudes on the outside of the carburetor body 22, and a lever 23 is secured to said protruding portion of the shaft 10. Said switch 24 is positioned in the way of movement of said lever 23 so that, although not shown, when the throttle valve 11 opens wide enough to let the throttle valve 14 open, said switch 24 is turned off. The shaft 13 of the throttle valve 14 provided in the secondary side mixture passage 8 projects to the outside of the carburetor body 22, and a plate 26 having a stopper 25 is rotatably mounted to the projection of said shaft 13, said plate 26 being urged to turn counterclockwise by a spring 27 interposed between said plate 26 and the carburetor body 22. To a part of the shaft 13 exposed outside of the plate 26 is secured a lever 28 which is held back by the stopper 25. In normal running of the engine, said lever 28 abuts on the stopper 25 and the throttle valve 14 is kept in its closed position under the pressing force of spring 27. Secured to the end of the plate 26 is an end of a link 30 which has a pawl 29 at its other end, whereby when the throttle valve 11 is turned counterclockwise to a position close to the maximum open position, the lever 23 is engaged with said pawl 29, causing the plate 26 to turn now clockwise through the link 30. Said lever 23 may be arranged to serve directly as an electric terminal whereby to effect connection and disconnection to power. In this case, switch 24 is not needed.

In operation of the above-described mixture supply system of the present invention, when motor 19 is operated to run the engine in normal condition, the fuel-air mixture is supplied through the primary side mixture passage 7 in the double throw carburetor 4 to flow on the disc 15 provided in the intake manifold 2. As the mixture is revolved by the disc 15, vaporization and atomization of fuel is expedited, and the mixture is evenly fed into the respective branch pipes 2'.

When the throttle valve 11 is opened close to the maximum degree with, for instance, increase of engine load, the lever 23 is turned counterclockwise by the shaft 10 to control or break the switch 24 to shut off supply of current from motor 20 to coil 19, whereupon the lever 23 engages the pawl 29 and turns it counterclockwise, causing the plate 26 to correspondingly turn clockwise through link 30 against force of spring 27, so that the lever 28 separates from stopper 25 and throttle valve 14 is opened by means not shown. Under this situation, mixture flows into the intake manifold 2 from both primary and secondary side mixture passages 7 and 8. Even though the disc 15 is not now rotating, the mixture supplied into the respective branch pipes 2' will be still generally uniform. Also, as only a very small amount of mixture is supplied from the secondary side mixture passage during this period, no problem arises in this connection.

Figure 4:
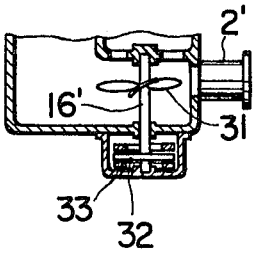
FIG. 4 is a sectional view of the principal parts of a mixture supply system according to another embodiment of the present invention.

Referring now to FIG. 4, there is shown another embodiment of the present invention. In this embodiment, a blade 31 is provided in place of disc 15 in the preceding embodiment. The revolving shaft 16' of said blade 31 is supported by a bearing 17 similar to that used in the preceding embodiment. Said shaft 16' projects outside of the intake manifold 2, and a disc 32 is mounted to the projected part of said shaft 16'. Around said disc 32 are provided electromagnetically operated brake means 33, and as in the foregoing embodiment, a switch 24 is provided to connect or disconnect said brake means to power.

According to this arrangement, the blade 31 is rotated by the mixture flowing in from the primary side mixture passage 7 to expedite vaporization of fuel in the mixture, and the mixture is evenly distributed into the respective branch pipes 2'. Also, when the throttle valve 11 opens nearly to full open condition and the switch 24 is changed over or controlled, brakes 33 operate to bring the blade 31 to a stop.

According to the present invention, as described above, vaporization of fuel in the fuel-air mixture as well as atomization of the mixture is greatly expedited by virtue of the rotary member to appreciably improve performance and transient response of the engine. Also, starting of the engine when it is cold is improved, and further, as a lean mixture is supplied into the engine during running of the vehicle, exhaust gas released from the engine contains little CO and HC. Moreover, since the branch pipes are provided equidistantly from each other around the junction of the intake manifold, the mixture is fed in equal amounts to the respective branch pipes. Still further, as the rotary member is stopped when the mixture is supplied into the intake manifold from the secondary side mixture passage, the uniform distribution of the mixture won't be affected. The present invention can be also adapted to a single throw carburetor where a single carburetor unit is used for vaporization of mixture.

What we claim is:

1. A fuel-air supply system comprising:

a two-barrel carburetor having a primary side mixture passage and a secondary side mixture passage therein, a first throttle valve in said primary side mixture passage, a rotatable shaft on which said first throttle valve is mounted, and a second throttle valve in said secondary side mixture passage, said first throttle valve being operatively associated with said second throttle valve, an intake manifold fluidly communicating with said carburetor, said intake manifold having branch pipes and a junction from which said branch pipes extend equidistantly from each other, the center axis of said primary side mixture passage being aligned with the center of the junction of the intake manifold, a rotary member in the junction of said intake manifold, said branch pipes extending radially from said rotary member, and a switch adjacent said rotatable shaft for controlling rotation of said rotary member, said switches being controlled by rotation of said rotatable shaft, whereby when said second throttle valve is opened, said switch is controlled to stop rotation of said rotary member.

2. A fuel-air supply system as claimed in claim 1, further comprising:

a lever connected to said rotatable shaft so as to be movable therewith, said lever being engagable with said switch upon a predetermined rotation of said rotatable shaft.

3. A fuel-air supply system as claimed in claim 1, wherein:

said rotary member is rotatable about an axis aligned with the center of the junction of the intake manifold and the center axis of the primary side mixture passage.

4. A fuel-air supply system as claimed in claim 3, wherein:

said rotary member comprises a disc.

5. A fuel-air supply system as claimed in claim 4, wherein:

said rotary member comprises a blade having a plurality of radially extending arms.

6. A fuel-air supply system comprising:

a two-barrel carburetor having a primary side mixture passage and a secondary side mixture passage therein, a first throttle valve in said primary side mixture passage, said first throttle valve being rotatable about an axis, and a second throttle valve in said secondary side mixture passage.

said first throttle valve being operatively associated with said second throttle valve, an intake manifold fluidly communicating with said carburetor, said intake manifold having branch pipes and a junction from which said branch pipes extend, the center axis of said primary side mixture passage being substantially aligned with the center of the junction of the intake manifold, a rotary member in the junction of the intake manifold, and means for controlling rotation of said rotary member, said means being operable to stop rotation of said rotary member when said second throttle valve is opened.

7. A fuel-air supply syste as claimed in claim 6, wherein:

said rotary member is rotatable about an axis aligned with the center of the junction of the intake manifold and the center axis of the primary side mixture passage.

8. A fuel-air supply system as claimed in claim 7, wherein:

said rotary member comprises a disc.

9. A fuel-air supply system as claimed in claim 7, wherein:

said rotary member comprises a blade having a plurality of radially extending arms.

* * * * *